United States Patent [19]

Bloise

[11] 4,301,547

[45] Nov. 24, 1981

[54] RAIN CAPE FOLDABLE INTO AN ENCLOSED HANDBAG

[76] Inventor: Sherry Bloise, 41 S. Central Ave., Valley Stream, N.Y. 11580

[21] Appl. No.: 151,401

[22] Filed: May 19, 1980

[51] Int. Cl.[3] ..... A41D 3/08

[52] U.S. Cl. ..... 2/88

[58] Field of Search ..... 2/85, 88, 84, 87; 150/1

[56] References Cited

U.S. PATENT DOCUMENTS 2,971,198 2/1961 Tomich ..... 2/88

4,078,264 3/1978 DeGennaro et al. ..... 2/88

FOREIGN PATENT DOCUMENTS 815934 10/1951 Fed. Rep. of Germany ..... 2/85

*Primary Examiner*—Doris L. Troutman

*Attorney, Agent, or Firm*—James P. Malone

[57] ABSTRACT

A cape foldable into an enclosed handbag. A thin foldable one piece cape member has a pair of hand apertures in the sides. A pair of pockets are on the front of the cape member. A first zipper portion encircles one pocket. A second zipper portion encircles the other pocket. Whereby the cape may be folded into a package having one pocket on one side and the other pocket on the other side so that when the zipper portions around the pockets are joined and closed, the cape is completely enclosed between the pockets so that the package may be used as a handbag.

1 Claim, 3 Drawing Figures

RAIN CAPE FOLDABLE INTO AN ENCLOSED HANDBAG

TECHNICAL FIELD

This invention relates to rain capes for emergency use and more particularly to such capes which are foldable into a package which may be used as a pocketbook, or handbag.

There is a need for rain capes for emergency use which can be conveniently folded into a compact package which may be easily carried and which can also function as a pocketbook.

BACKGROUND ART

Prior foldable emergency rain capes are shown by U.S. Pat. Nos. 2,462,269 2,911,651 2,971,198 3,258,781 3,522,612 3,849,803 4,067,067.

The prior rain capes illustrated by the above patents generally fold into a package which is generally too bulky to be inserted into a pocketbook so that it must be carried separately, which severely limits their utility.

THE INVENTION

The present invention provides an emergency rain cape foldable into a package which has separate utility as a pocketbook.

In the present invention, there are two pockets on the front of the cape. Each pocket is encircled by one portion of a zipper. The cape may be folded so that one pocket is on one side of the package and the other pocket is on the other side of the package so that when the zipper portions around the pockets are joined and closed, the package may also be used as a pocketbook, since the pockets are on either side of the package.

OBJECTS OF THE INVENTION

Accordingly, a principal object of the invention is to provide new and improved foldable rain cape means.

Another object of the invention is to provide new and improved foldable rain cape means which may be folded into a package having pockets on either side so that the package may be used as a pocketbook.

Another object of the invention is to provide a new and improved cape foldable into an enclosed package comprising; a thin foldable one piece cape member, a pair of hand apertures in the sides of said cape member, a pair of pockets on the front of the cape member, a first zipper portion connected to and encircling one pocket, a second zipper portion connected to and encircling the other pocket, whereby the cape may be folded into a package having one pocket on one side and the other pocket on the other side so that when the zipper portions around the pockets are joined and closed the cape is completely enclosed between the pockets so that the package may be used as a pocketbook.

These and other objects of the invention will be apparent from the following specification and drawings of which:

BEST MODE OF THE INVENTION

Figure 1:
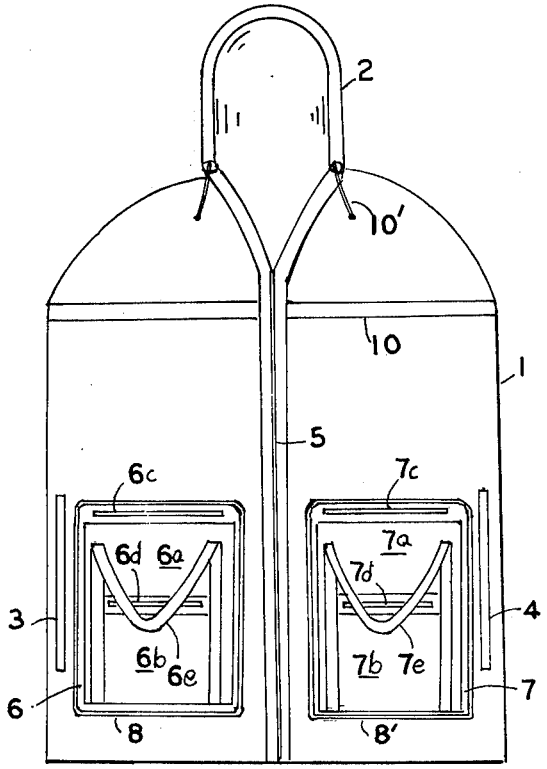
FIG. 1 is a front view of an embodiment of the invention.

Referring to the figures, the invention comprises a cape member 1, of thin foldable material, preferably waterproof. The material may be a commercially available plastic material with a nylon backing. This type of material is durable, easily foldable and easy to sew.

A hood member 2 of the same material is attached to the top of the cape member 1. The cape has a pair of hand slits 3 and 4, and a conventional zipper member 5 on the front.

A pair of double pockets 6 and 7, are mounted on the front of the cape member 1. Each double pocket comprises a large pocket *6a, 7a,* and a small pocket *6b, 7b,* mounted on top of the large pocket. Each section has its own zipper *6c, 6d,* and *7c, 7d.* Each pocket has a handle portion *6e, 7e.*

The pocket 6 is encircled by a first zipper portion 8, which comprises one side of the complete zipper. The pocket 7, is encircled by the second zipper portion 8'. A yoke 10, encircles the cape at the shoulder level to provide a good fit at the shoulder.

Figure 2:
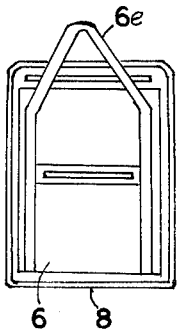
FIG. 2 is a view of the embodiment of FIG. 1 folded up into a package which may be used as a pocketbook.
Figure 3:
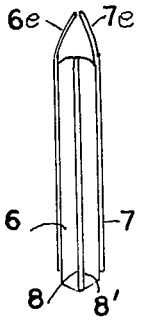
FIG. 3 is a side view of FIG. 2.

As shown in FIGS. 2 and 3, the cape may be folded up so that the pocket 6 is on one side and the pocket 7 is on the other side. The zipper 8 is then joined and closed forming a compact package shown. Because of the handles *6e, 7e,* the package may be easily carried. Also, because the pocket sections *6a, 6b* and *7a, 7b,* are on the outside, the package may be used as a handbag thereby greatly increasing its utility.

The hood 2, has a drawstring 10' through the front seam in order to tighten the hood.

It is claimed:

1. A cape foldable into an enclosed package comprising:

a thin foldable one piece cape member, a pair of hand apertures in the sides of said cape member, a pair of pockets on the front of the cape member, a first zipper portion connected to and encircling one pocket, a second zipper portion connected to and encircling the other pocket, whereby the cape may be folded into a package having one pocket on one side and the other pocket on the other side so that when the zipper portions around the pockets are joined and closed the cape is completely enclosed between the pockets, so that the package may be used as a handbag, each pocket comprising a first large pocket section and a second small pocket section mounted on the large pocket section.

* * * * *